US006824677B2

(12) United States Patent
Martinez

(10) Patent No.: US 6,824,677 B2
(45) Date of Patent: Nov. 30, 2004

(54) CURBSIDE TRAP FOR POLLUTANTS AND SOLID TRASH

(76) Inventor: Antonio Martinez, 2413 N. Mountain View Rd., El Monte, CA (US) 91733

( * ) Notice: Subject to any disclaimer, the term of this patent is extended or adjusted under 35 U.S.C. 154(b) by 3 days.

(21) Appl. No.: 10/266,982

(22) Filed: Oct. 8, 2002

(65) Prior Publication Data

US 2004/0065601 A1 Apr. 8, 2004

(51) Int. Cl.[7] ..... E03F 5/14

(52) U.S. Cl. ..... 210/97; 210/131; 210/162; 210/163; 210/170; 210/156; 404/4

(58) Field of Search ..... 210/97, 163, 164, 210/170, 130, 131, 156, 158, 236, 354, 153; 404/4, 5; 405/40

(56) References Cited

U.S. PATENT DOCUMENTS 809,201 A * 1/1906 Lutz ..... 210/314
5,403,474 A * 4/1995 Emery ..... 210/163
5,419,832 A * 5/1995 Heinen et al. ..... 210/160
5,849,198 A * 12/1998 Sharpless ..... 210/693
5,855,774 A * 1/1999 Boelter ..... 210/115
6,106,706 A * 8/2000 Roy et al. ..... 210/99
2003/0132150 A1 * 7/2003 Happel ..... 210/163

* cited by examiner

*Primary Examiner*—Terry K. Cecil
(74) *Attorney, Agent, or Firm*—Donald D. Mon

(57) ABSTRACT

A trap for a curbside drain opening to exclude solids of excessive size from the drain and trap them for analysis and recovery. The trap has a face which will open at high rates of water flow to avert flooding that might be or caused by plugging the drain opening. A filter is optionally provided to remove selected pollutants from the water stream for recovery and analysis.

6 Claims, 3 Drawing Sheets

CURBSIDE TRAP FOR POLLUTANTS AND SOLID TRASH

FIELD OF THE INVENTION

The capture and analysis of pollutants and solid trash that originate from curbside gutters.

BACKGROUND OF THE INVENTION

Solid trash that accumulates in a gutter and is not swept away ultimately enters a drain somewhere. Similarly, liquid flowing in the gutter enters these drains. Both of these are troublesome. Solid material must be cleared out of drains and check dams so the systems do not become plugged and the surrounding areas become flooded in a heavy storm.

The liquids often include pernicious material such as insecticides, fertilizers and engine oil. These will ultimately reach a river, a lake or an ocean, and will pollute them as a source of water or food. Such problems have long been tolerated, because the extent of their usage has only gradually challenged the capacity of the earth to contend with them. However, it is now becoming evident that the earth's capacity to deal with these has been over-estimated.

The costs of keeping drainage systems open have been assumed to be an acceptable and necessary charge. The increasing awareness of these expenses and problems is leading to vigorous efforts to reduce them at their very source by detecting and detaining them at or very near to their source.

Thus, it is a matter of importance to become aware of what the trash is and where it comes from. Similarly, the source of liquid or dissolved pollutants must be learned before they can be stopped.

It is an object of this invention to provide an economical and conveniently serviced device to capture the trash and pollutants so they can be identified and their sources learned.

There is a problem inherent in such traps. The retained trash could itself clog the drain if it already filled the trap when a heavy rainfall occurs. Accordingly it is another object of this invention to provide a trap which can open and dump the clogging material when it is heavily burdened and the water flow is rapid. While this will release some trash into the drainage system, the downstream system will have previously been kept clear, and the amount of trash disgorged into it will be too small to plug the larger system. Meanwhile, before this event occurs, solid trash can be collected, analyzed and carried away, and the pollutants defined.

It is an object of this invention to provide a conveniently serviced system for this purpose, which has a provision to be over-ridden when adverse conditions occur, such as a heavy storm.

BRIEF DESCRIPTION OF THE INVENTION

According to this invention, a frame is fitted into a curb opening through which runoff water and accompanying trash is normally expected to pass into a catch basin. The base includes a horizontal track inside the catch basin and a sill.

According to this invention a cage-like trap is mounted to the track so it can slide through the opening and into and out of the catch basin. It has an open front face facing outwardly with the opening, and bounding sides at least some of which are pervious to water flow.

The trap includes a rear face facing into the catch basin. This rear face is hinged so as to open and permit unrestricted flow of water in the event of high flow rates such as a heavy rain. In such event, the contents, if any, of the trap will be washed into the catch basin.

Because of the track relationship, the trap can be removed by an axial pull, and its contents analyzed and carried away.

As an optional feature of the invention a filter may be placed beneath the trap where it will collect pollutants of interest as defined by the selected filter medium. If desired, the filter trays holding the filter pads can be supported directly from the base, with the advantage that when the trap is removed for servicing, the filter pads will be directly accessible through the opening.

As a preferred but optional feature, the rear face of the trap can be biased toward its closed position by a hinge spring, or held by magnets, in any event to be opened when a heavy water flow arrives.

The above and other features of this invention will be fully understood from the following detailed description and the accompanying drawings, in which:

DETAILED DESCRIPTION OF THE INVENTION

Figure 1:
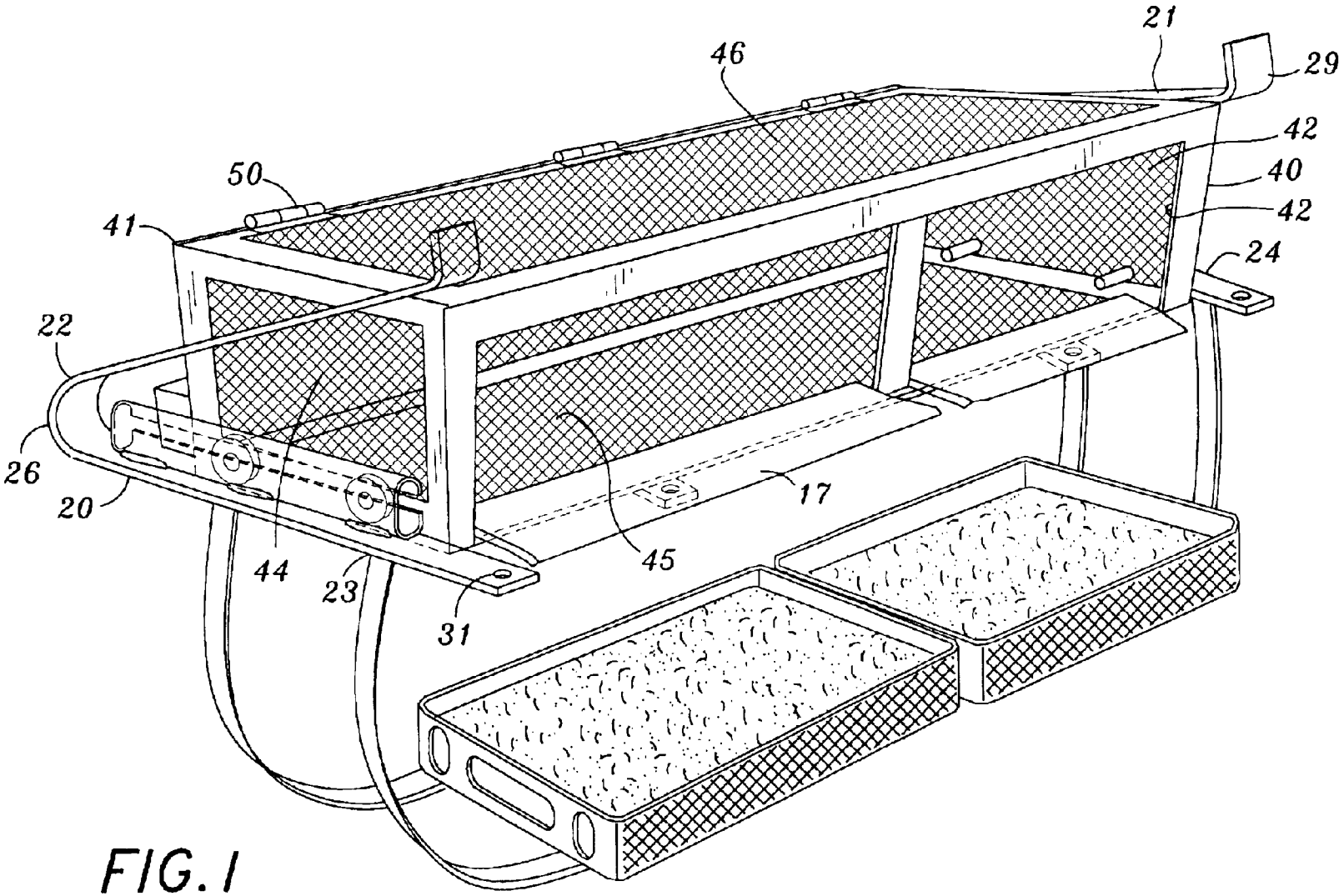
FIG. 1 is a perspective view of the elements of this invention.
Figure 2:
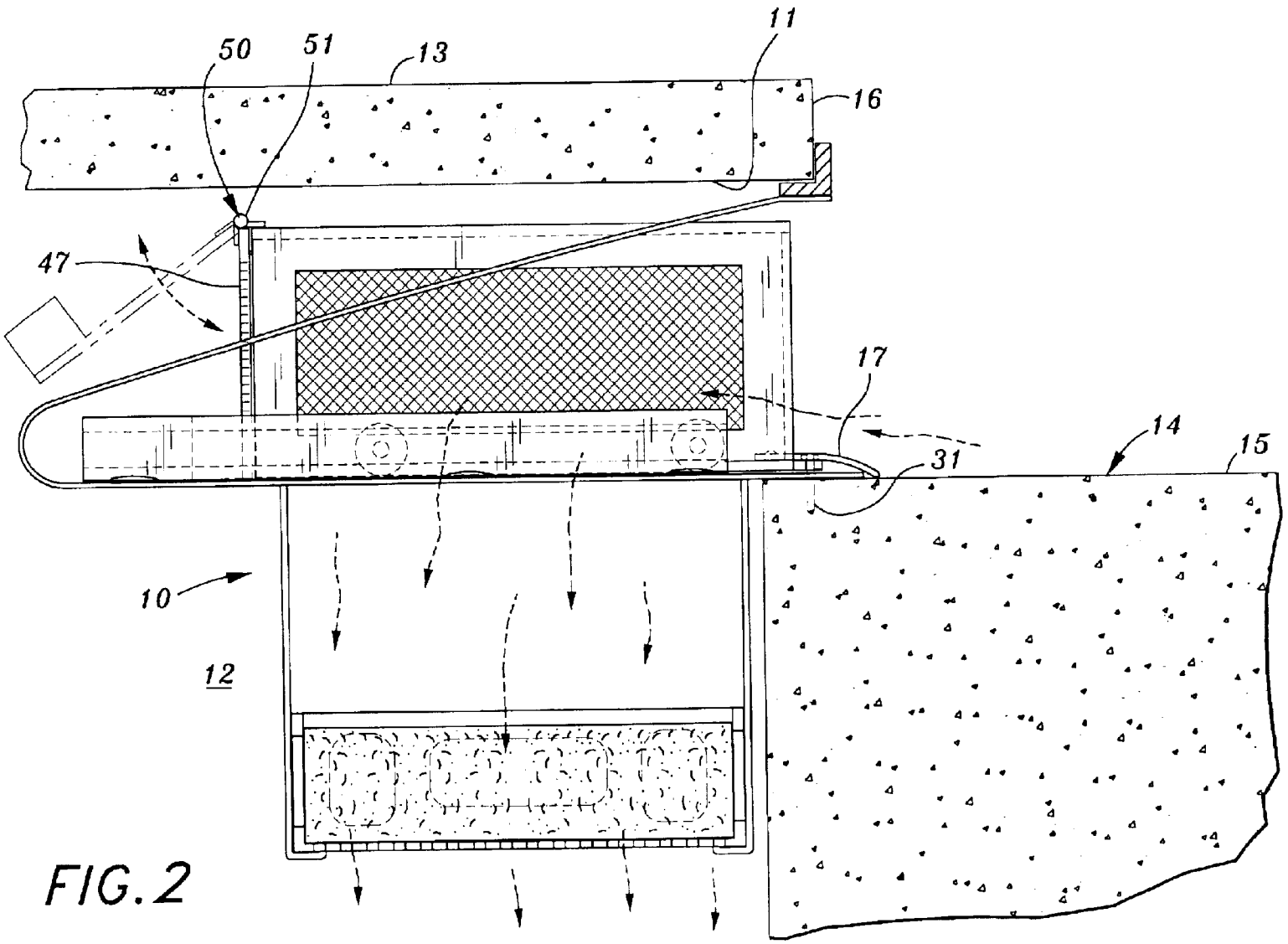
FIG. 2 is a side view showing the elements of FIG. 1 installed in a catch basin.

FIG. 2 shows the system 10 of this invention installed in a curbside opening 11 that opens into a catch basin 12. A cover 13 such as a sidewalk overlays the catch basin. The gutter 14 has a flow surface 15, and a wall 16 that defines part of the catch basin. Water from the gutter, and its burden of trash and pollutants are intended to flow over a sill 17 toward the catch basin.

A frame 20 comprises a pair of U-shaped end pieces 21, 22. These pieces are joined together by lateral beams (not shown). Base arms 23, 24 are joined by bights 25, 26 to springy arms 27, 28. Arms 27 and 28 carry a flange 29 that bears against the wall of the opening. Arms 23, 24 are held to the gutter by spikes 31 or other hold-down means.

Figures 3, 4:
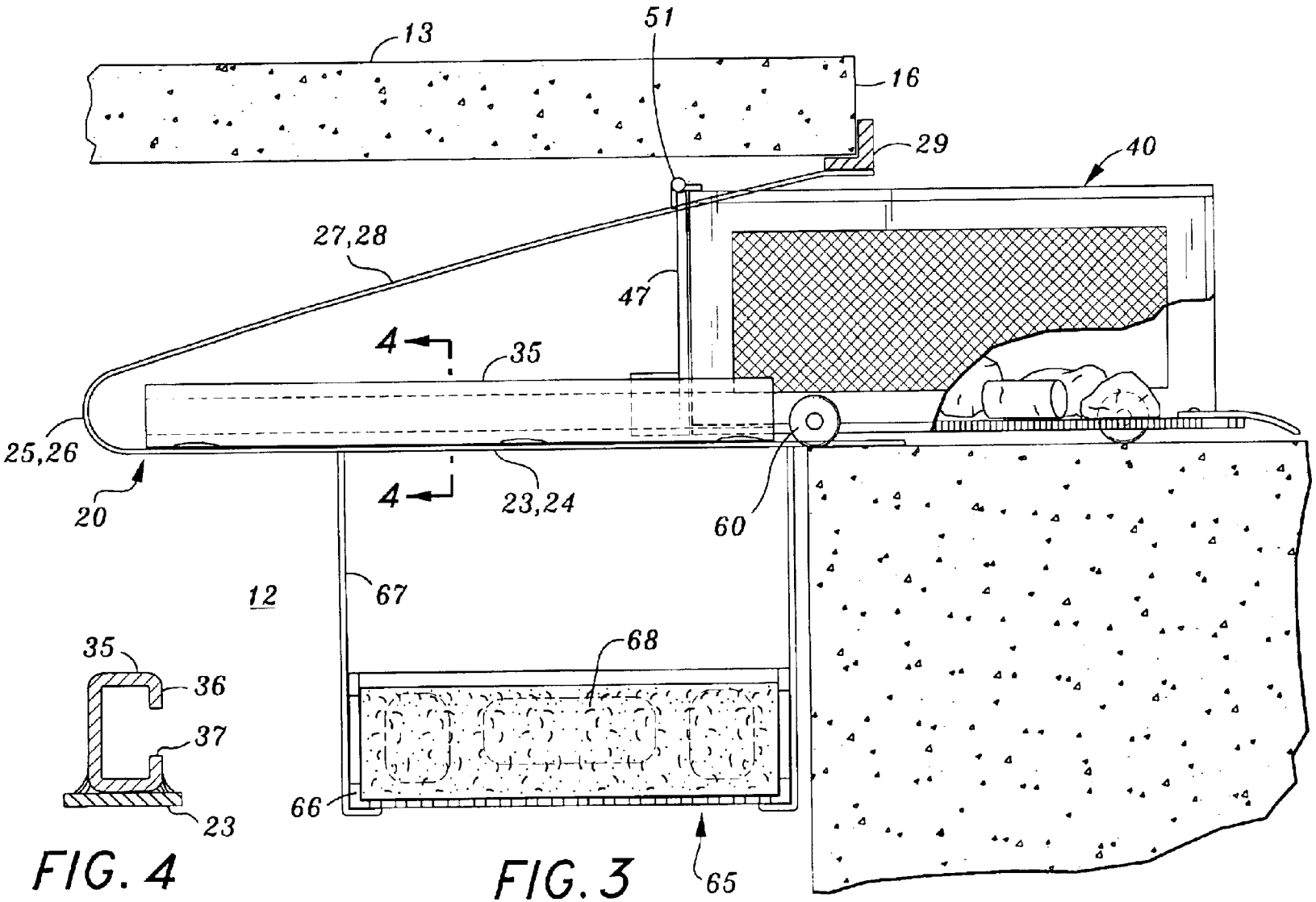
FIG. 3 shows the trap partially removed for service.
FIG. 4 is a cross-section taken at line 4—4 in FIG. 3.

As shown in FIG. 4 a C-shaped track 35 is welded to each of the base arms. Only the track on base arm 23 is shown. The track has flanges 36 and 37 to trap wheels as will be shown. It is open at its end closest to the gutter. Its other end may be blocked.

Trap 40 is a hollow structure, having a frame 41, but with perforated sides, top and bottom which facilitate the passage of water while retaining solids of given size or larger. In particular it has an open front face 42 facing into the gutter, side faces 43, 44, a bottom face 45, a top face 46, and a rear face 47. The front face is open to permit access for everything. At least the bottom, and preferably also the rear and sides permit flow of water through them. When permitted, they will be perforated, such as screens.

Importantly, at least one of the sides can be opened into the catch basin to release trapped solids in the event of heavy water flow. Most conveniently this will be rear face 47. As shown in FIG. 2, it is hinged at the top by a hinge 50 so it can swing out to tilt open as shown in dashed line.

A coil hinge spring 51 can be provided to bias the rear face toward its closed position. Alternatively, magnets may be attached to the frame or rear face or both to hold the hinged face closed until a sufficient force is exerted to open the face. Magnets have the advantage that when the face is released, it opens further without impediment, while a spring will increase its resistive force as the face continues to open.

The trap is shown as a rectangular shape. Instead, and sometimes preferentially, it may have a parallelogram side elevation, or a sloped rear face, which will more readily be opened by a shove exerted by the solids or by heavy water flow.

Wheels 60 are mounted to the sides of the frame, and fit into the C-sectioned tracks. The trap can readily be removed by running the wheels past the open front ends of the tracks.

A filter basket 65 is supported underneath the trap where water will drain into it. A support frame 66 is supported by straps 67. Notice that when the trap is removed, filters 68 in the frame can conveniently be reached for service. The filter is of any desired type to retain substances of interest. It is porous, and the frame is perforated to pass water that has passed through the pads.

This apparatus is readily installed in existing curb openings, and is adapted to fit in various heights because of the springy arms.

This invention is not to be limited by the embodiment shown in the drawings and described in the description, which is given by way of example and not of limitation, but only in accordance with the scope of the appended claims.

I claim:

1. A curbside trap system to be fitted into an opening in a curb entering into a drain system, said trap system comprising:

a frame adapted to fit in said curbside opening;

a track on said frame;

a trap comprising a structure having an open end facing outwardly into said opening, a bottom, a pair of opposite side faces, and an end face opposite from said open end, at least said bottom being perforated to permit flow of water into said drain system, said perforations being of size small enough to retain solids of excessive size, said end face being hinged to tilt when water at a sufficiently high rate of flow impinges on it or on solids in said trap to open said structure at said end face and thereby permit free flow of solids and water from said structure into said drain system;

said trap structure being movably engaged to said tracks, whereby to be movable out of said drain system for removal of solids trapped therein.

2. A curbside trap system according to claim 1 in which said frame comprises a pair of springy arms adapted to engage edges of said opening to mount said frame thereto.

3. A curbside tray system according to claim 1 in which all of said faces are perforated, and said end face is hinged at its top as to swing upwardly and away from said side faces so as to open said structure when high flow rates occur.

4. A curbside trap system according to claim 1 in which a filter is suspended from said frame beneath the location occupied by the trap when fully inserted into the curb, said filter being directly accessible through said curb opening when said trap is removed from said frame.

5. A curbside trap system according to claim 1 in which said end face includes a bias spring biasing its position to close the structure but enabling the end face to be moved when a sufficient force is exerted on it.

6. A curbside trap system according to claim 1 in which a magnet normally holds the end face in its closed position, but whose strength is such as to be overcome by a sufficient force to enable the end face to open.

* * * * *